US009589522B2

(12) United States Patent
Shin et al.

(10) Patent No.: US 9,589,522 B2
(45) Date of Patent: Mar. 7, 2017

(54) METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

(71) Applicant: Samsung Display Co., LTD., Yongin, Gyeonggi-Do (KR)

(72) Inventors: Yong-Jin Shin, Asan-si (KR); Sung-In Kang, Hwaseong-si (KR); Tae-Gwang Jeong, Asan-si (KR); Bong-Kyun Jo, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 14/546,067

(22) Filed: Nov. 18, 2014

(65) Prior Publication Data

US 2015/0154931 A1 Jun. 4, 2015

(30) Foreign Application Priority Data

Dec. 3, 2013 (KR) ..... 10-2013-0149456

(51) Int. Cl.
*G09G 3/36* (2006.01)

(52) U.S. Cl.
CPC ..... *G09G 3/3648* (2013.01); *G09G 3/3614* (2013.01); *G09G 2320/0252* (2013.01)

(58) Field of Classification Search
CPC ..... G09G 3/3648; G09G 3/3614; G09G 2320/0252
See application file for complete search history.

(56) References Cited

U.S. PATENT DOCUMENTS

2006/0164355 A1* 7/2006 Kim ..... G09G 3/3648 345/89
2009/0009498 A1* 1/2009 Nishimura ..... G09G 3/3688 345/205
2010/0033475 A1* 2/2010 Choi ..... G09G 3/3648 345/214
2012/0256975 A1 10/2012 Yukawa

FOREIGN PATENT DOCUMENTS

JP 2004139095 B2 5/2004
JP 2010049014 A 3/2010
KR 1020050031145 A 4/2005
KR 1020060125041 A 12/2006
KR 1020080053802 A 6/2008
KR 1020120066539 A 6/2012

* cited by examiner

*Primary Examiner* — Liliana Cerullo
(74) *Attorney, Agent, or Firm* — Cantor Colburn LLP

(57) ABSTRACT

A method of driving a display panel includes applying a gate signal to a gate line of a display panel to drive the gate line, and driving a data line of the display panel by applying a data signal to the data line, where the driving the data line of the display panel includes over-driving the data line based on a data load signal and a polarity control signal.

8 Claims, 7 Drawing Sheets

METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

This application claims priority to Korean Patent Application No. 10-2013-0149456, filed on Dec. 3, 2013, and all the benefits accruing therefrom under 35 U.S.C. §119, the content of which in its entirety is herein incorporated by reference.

BACKGROUND

1. Field

Exemplary embodiments of the invention relate to a method of driving a display panel, a display panel driving apparatus for performing the method and a display apparatus including the display panel driving apparatus. More particularly, exemplary embodiments of the invention relate to a method of driving a display panel for over-driving the display panel, a display panel driving apparatus for performing the method and a display apparatus including the display panel driving apparatus.

2. Description of the Related Art

A display panel of a liquid crystal display apparatus typically includes a lower substrate, an upper substrate and a liquid crystal layer. The lower substrate may include a switching element such as a thin film transistor and a pixel electrode. The upper substrate may include a common electrode. The liquid crystal layer is interposed between the lower substrate and the upper substrate, and includes a liquid crystal, an arrangement of which is changed by an electric field between a pixel voltage applied to the pixel electrode and a common voltage applied to the common electrode.

However, when a response speed of the liquid crystal is comparatively low, display quality of an image displayed on the display panel may be decreased.

A dynamic capacitance compensation method has been developed to increase the response speed of the liquid crystal. The dynamic capacitance compensation method compares a luminance of a previous frame and a luminance of a frame and applies a luminance difference generated from the comparison to a lookup table set in advance to increase a level of a data signal applied to the pixel electrode.

However, in the dynamic capacitance compensation method, a memory device is typically used for storing the lookup table.

SUMMARY

Exemplary embodiments of the invention provide a method of driving a display panel that reduces the manufacturing cost of the display apparatus.

Exemplary embodiments of the invention also provide a display panel driving apparatus for performing the above-mentioned method.

Exemplary embodiments of the invention also provide a display apparatus including the above-mentioned display panel driving apparatus.

According to an exemplary embodiment of the invention, a method of driving a display panel includes applying a gate signal to a gate line of the display panel to drive the gate line, and driving a data line of the display panel by applying a data signal to the data line, where the driving the data line of the display panel includes over-driving the data line based on a data load signal and a polarity control signal.

In an exemplary embodiment, the driving the data line of the display panel may include converting an image data of digital type into an analog image data of analog type, and determining whether the data load signal is in an activation state or in a deactivation state.

In an exemplary embodiment, the driving the data line of the display panel may include outputting the analog image data as the data signal to the data line when the data load signal is in the deactivation state.

In an exemplary embodiment, the driving the data line of the display panel may further include determining whether the polarity control signal is in a high level or in a low level.

In an exemplary embodiment, the outputting the analog image data as the data signal to the data line may include outputting a first voltage, which is greater than a common voltage, as the data signal to the data line when the polarity control signal is in the high level.

In an exemplary embodiment, the outputting the analog image data as the data signal to the data line may include outputting a second voltage, which is less than a common voltage, as the data signal to the data line when the polarity control signal is in the low level.

In an exemplary embodiment, the driving the data line of the display panel may further include determining whether the polarity control signal is in a high level or in a low level when the data load signal is in the activation state.

In an exemplary embodiment, the over-driving the data line of the display panel may include outputting a third voltage, which is greater than a first voltage of the analog image data, as the data signal to the data line when the polarity control signal is in the high level, where the first voltage of the analog image data is greater than a common voltage.

In an exemplary embodiment, the over-driving the data line of the display panel may further include outputting the third voltage during a period corresponding to an activation period of the data load signal.

In an exemplary embodiment, the over-driving the data line of the display panel may include outputting a fourth voltage, which is less than a second voltage of the analog image data, as the data signal to the data line when the polarity control signal is in the low level, where the second voltage of the analog image data is less than a common voltage.

In an exemplary embodiment, the over-driving the data line of the display panel may further include outputting the fourth voltage during a period corresponding to an activation period of the data load signal.

According to another exemplary embodiment of the invention, a display panel driving apparatus includes a gate driving part and a data driving part. The gate driving part is configured to apply a gate signal to a gate line of a display panel to drive the gate line. The data driving part is configured to apply a data signal to a data line of the display panel, wherein the data driving part, where the data driving part over-drives a data line of the display panel based on a data load signal and a polarity control signal.

In an exemplary embodiment, the data driving part may include a digital-analog converting part configured to convert an image data of digital type into an analog image data of analog type, and an over-driving part configured to receive the analog image data and to over-drive the data line based on the data load signal and the polarity control signal.

In an exemplary embodiment, the over-driving part may allow the analog image data to bypass when the data load signal is in a deactivation state such that the analog image data is output as the data signal to the data line when the data load signal is in the deactivation state.

In an exemplary embodiment, the over-driving part may output a first voltage, which is greater than a common voltage, as the data signal to the data line when the polarity control signal is in a high level.

In an exemplary embodiment, the over-driving part may output a second voltage, which is less than a common voltage, as the data signal to the data line when the polarity control signal is in a low level.

In an exemplary embodiment, the over-driving part may determine whether the polarity control signal is in a high level or in a low level when the data load signal is in an activation state.

In an exemplary embodiment, the over-driving part may output a third voltage, which is greater than a first voltage of the analog image data, as the data signal to the data line when the polarity control signal is the high level, where the first voltage of the analog image data is greater than a common voltage, and the over-driving part may output a fourth voltage, which is less than a second voltage of the analog image data, as the data signal to the data line when the polarity control signal is the low level, where the second voltage of the analog image data is less than the common voltage.

In an exemplary embodiment, the display panel driving apparatus may further include a timing controlling part configured to output a gate control signal to the gate driving part and output a data control signal to the data driving part, and the timing controlling part and the data driving part may be disposed in a single chip.

According to still another exemplary embodiment of the invention, a display apparatus includes a display panel and a display panel driving apparatus. The display panel is configured to display an image and includes a gate line and a data line. The display panel driving apparatus includes a gate driving part configured to apply a gate signal to the gate line to drive the gate line and a data driving part configured to apply a data signal to a data line of the display panel, where the data driving part over-drives the data line based on a data load signal and a polarity control signal.

According to exemplary embodiments of the invention, a data line is over-driven without a memory device typically used in a dynamic capacitance compensation ("DCC") method, and thus a manufacturing cost of the display apparatus may be decreased.

In such embodiments, a response speed of a liquid crystal included in a display panel of the display apparatus is increased, and thus display quality of the display apparatus may be improved.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
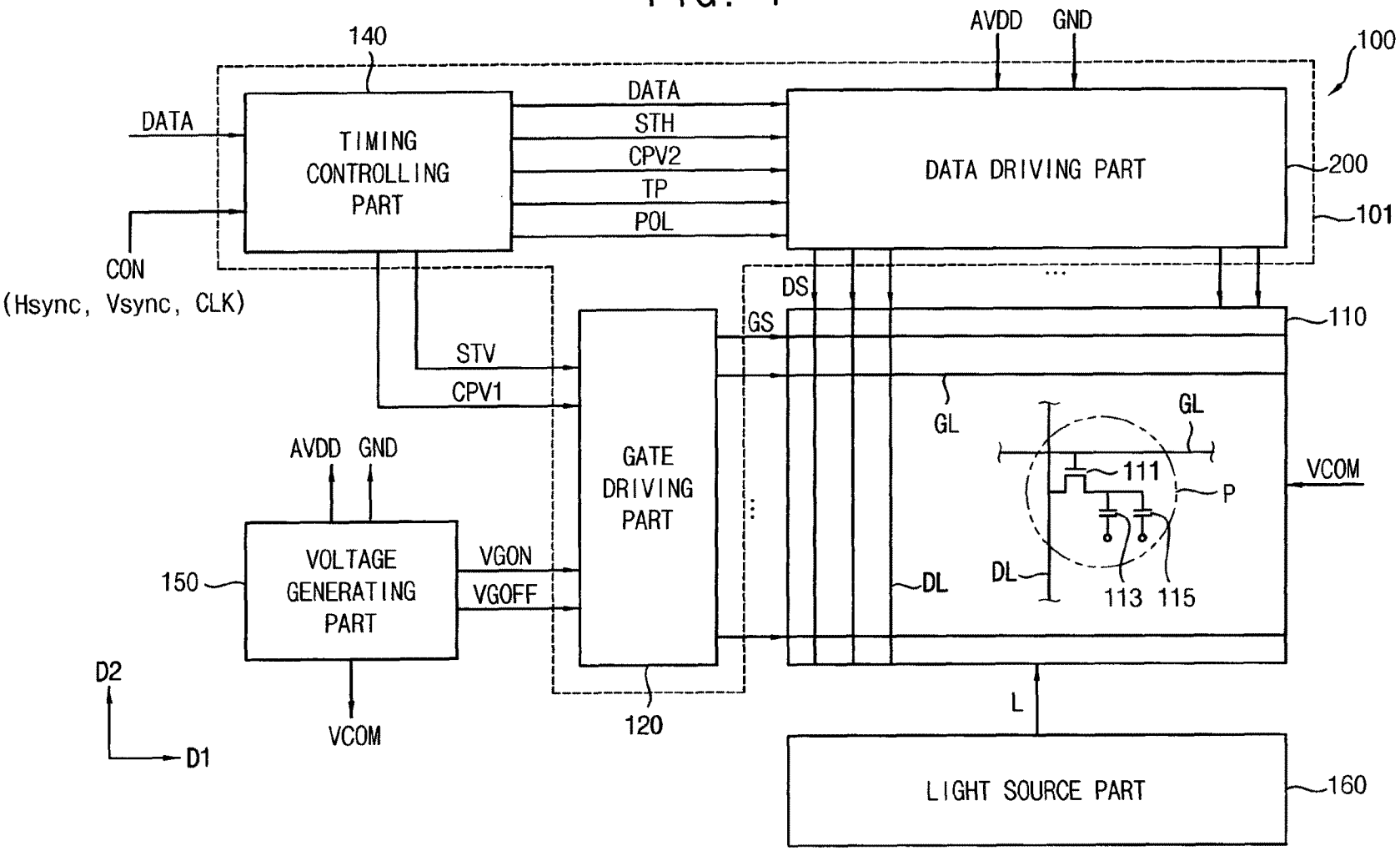
FIG. 1 is a block diagram illustrating an exemplary embodiment of a display apparatus, according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a block diagram illustrating an exemplary embodiment of a display apparatus, according to the invention.

Referring to FIG. 1, an exemplary embodiment of the display apparatus 100 includes a display panel 110, a display panel driving apparatus 101, a voltage generating part 150 and a light source part 160.

The display penal 110 receives a data signal DS based on an image data DATA to display an image. In one exemplary embodiment, for example, the image data DATA may be two-dimensional image data. Alternatively, the image data DATA may three-dimensional stereoscopic image data including a left-eye image data and a right-eye image data for displaying a three-dimensional stereoscopic image.

The display panel 110 includes a plurality of gate lines GL, a plurality of data lines DL and a plurality of pixels P. The gate line GL extends substantially in a first direction D1, and the data line DL extends substantially in a second direction D2 that is perpendicular to the first direction D1. The first direction D1 may be substantially parallel to a long side of the display panel 110, and the second direction D2 may be substantially parallel to a short side of the display panel 110. Each of the pixels P includes a thin film transistor 111 electrically connected to a corresponding gate line of the gate lines GL and a corresponding data line of the data lines DL, a liquid crystal capacitor 113 and a storage capacitor 115 connected to the thin film transistor 111.

In an exemplary embodiment, the display panel may include a lower substrate including the thin film transistor 111 and a pixel electrode, an upper substrate including a common electrode, and a liquid crystal layer including a liquid crystal, an arrangement of which is changed by an electric field between a pixel voltage of the pixel electrode and a common voltage of the common electrode. In such an embodiment, the display panel 110 may be a liquid crystal display panel, and the display apparatus 100 may be a liquid crystal display apparatus.

The display panel driving apparatus 101 drives the display panel 110. The display panel driving apparatus 101 includes a gate driving part 120, a data driving part 200 and a timing controlling part 140.

The gate driving part 120 generates a gate signal GS in response to a gate start signal STV and a gate clock signal CPV1 provided from the timing controlling part 140, and outputs the gate signal GS to the gate lines GL.

The data driving part 200 outputs the data signal DS based on the image data DATA to the data line DL in response to a data start signal STH and a data clock signal CPV2 provided from the timing controlling part 140. In an exemplary embodiment, the data driving part 200 over-drives the data line DL based on a data load signal TP and a polarity control signal POL. The data load signal TP is a signal that commands an application of a data voltage for outputting the data signal DS, and the polarity control signal POL is a signal that controls a polarity of the data signal DS. The data load signal TP and the polarity control signal POL are provided from the timing controlling part 140.

The timing controlling part 140 receives the image data DATA and a control signal CON from an outside. The control signal CON may include a horizontal synchronous signal Hsync, a vertical synchronous signal Vsync and a clock signal CLK. In an exemplary embodiment, the timing controlling part 140 generates the data start signal STH using the horizontal synchronous signal Hsync and outputs the data start signal STH to the data driving part 200. In such an embodiment, the timing controlling part 140 generates the gate start signal STV using the vertical synchronous signal Vsync and outputs the gate start signal STV to the gate driving part 120. In such an embodiment, the timing controlling part 140 generates the gate clock signal CLK1 and the data clock signal CLK2 using the clock signal CLK, outputs the gate clock signal CLK1 to the gate driving part 120 and outputs the data clock signal CLK2 to the data driving part 200. The gate start signal STV and the gate clock signal CPV1 may be defined as a gate control signal, and the data start signal STH and the data clock signal CPV2 may be defined as a data control signal.

In an exemplary embodiment, the timing controlling part 140 further outputs the data load signal TP and the polarity control signal POL to the data driving part 200.

In an exemplary embodiment, the voltage generating part 150 generates a gate on voltage VGON and a gate off voltage VGOFF, and provides the gate on voltage VGON and the gate off voltage VGOFF to the gate driving part 120. In such an embodiment, the voltage generating part 150 generates a common voltage VCOM, and provides the common voltage VCOM to the display panel 110. In such an embodiment, the voltage generating part 150 generates an analog voltage AVDD and a ground voltage GND, and provides the analog voltage AVDD and the ground voltage GND to the data driving part 200.

The light source part 160 generates light L, and provides the light L to the display panel 110. In one exemplary embodiment, for example, the light source part 160 may include a light emitting diode ("LED").

Figure 2:
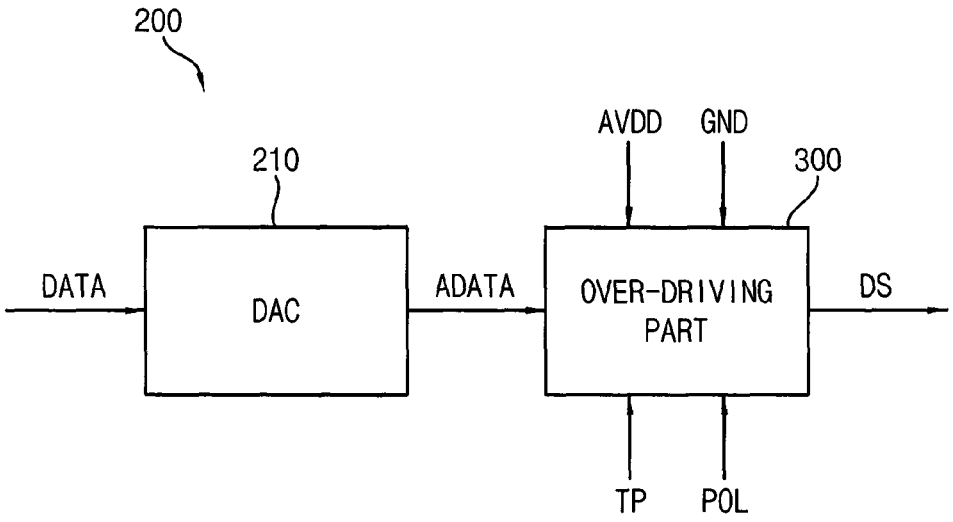
FIG. 2 is a block diagram illustrating an exemplary embodiment of a data driving part of FIG. 1.

FIG. 2 is a block diagram illustrating an exemplary embodiment of the data driving part 200 of FIG. 1.

Referring to FIGS. 1 and 2, an exemplary embodiment of the data driving part 200 includes a digital-analog converting ("DAC") part 210 and an over-driving part 300.

The digital-analog converting part 210 converts the image data DATA of digital type into an analog image data ADATA of analog type.

In an exemplary embodiment, the over-driving part 300 allow the analog image data ADATA from the digital-analog converting part 210 to bypass based on the data load signal TP provided from the timing controlling part 140 to output the analog image data ADATA as the data signal DS. In such an embodiment, the over-driving part 300 may allow the analog image data ADATA to bypass when the data load signal TP is in a deactivation state.

In an exemplary embodiment, the over-driving part 300 outputs the analog voltage AVDD and the ground voltage GND provided from the voltage generating part 150 to the data line DL based on the data load signal TP and the polarity control signal POL provided from the timing controlling part 140 to over-drive the data line DL. In such an embodiment, when the data load signal TP is in an activation state, the over-driving part 300 may output the analog voltage AVDD or the ground voltage GND as the data signal DS to over-drive the data lines DL.

Figure 3:
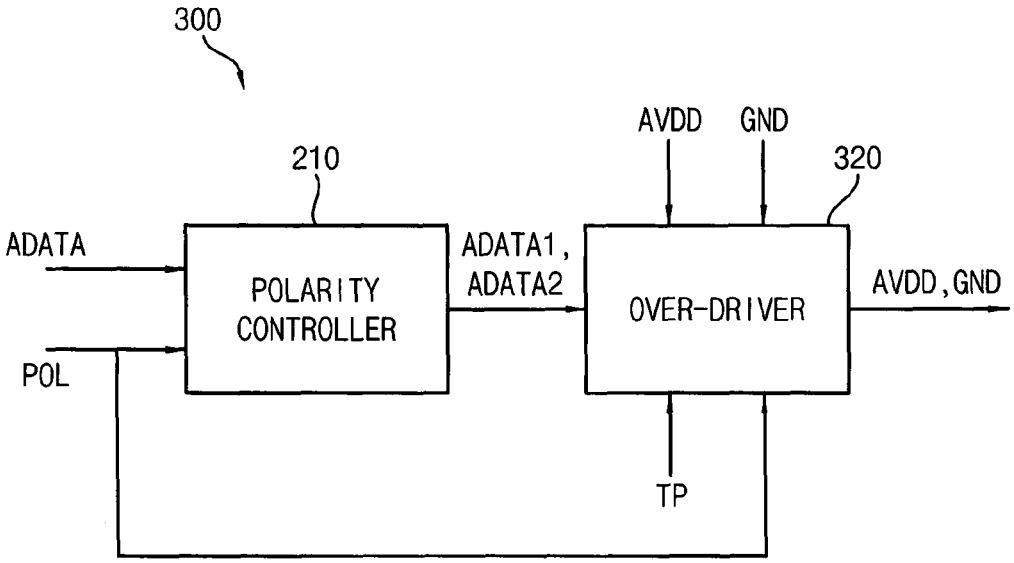
FIG. 3 is a block diagram illustrating an exemplary embodiment of an over-driving part of FIG. 2.

FIG. 3 is a block diagram illustrating an exemplary embodiment of the over-driving part 300 of FIG. 2.

Referring to FIGS. 1 to 3, an exemplary embodiment of the over-driving part 300 includes a polarity controller 310 and an over-driver 320.

The polarity controller 310 controls a polarity of the analog image data ADATA based on the polarity control signal POL. In one exemplary embodiment, for example, the polarity controller 310 may output a first analog image data ADATA1 having a voltage greater than the common voltage VCOM when the polarity control signal POL is in a high level, and may output a second analog image data ADATA2 having a voltage less than the common voltage VCOM when the polarity control signal POL is in a low level. Alternatively, the polarity controller 310 may output the first analog image data ADATA1 having the voltage greater than the common voltage VCOM when the polarity control signal POL is in the low level and may output the second analog image data ADATA2 having the voltage less than the common voltage VCOM when the polarity control signal POL is in the high level.

The over-driver 320 allows the first analog image data ADATA1 or the second analog image data ADATA2 to bypass or outputs the analog voltage AVDD and the ground voltage GND, based on the data load signal TP.

In an exemplary embodiment, when the data load signal TP is in the deactivation state, the over-driver 320 allows the first analog image data ADATA1 or the second analog image data ADATA2 to bypass. In such an embodiment, when the data load signal TP is in the activation state, the over-driver 320 outputs the analog voltage AVDD and the ground voltage GND.

In one exemplary embodiment, for example, when the data load signal TP is in the activation state and the polarity control signal POL is in the high level, the over-driver 320 may output the analog voltage AVDD as the data signal DS, and when the data load signal is in the activation state and the polarity control signal POL is in the low level, the over-driver 320 may output the ground voltage GND as the data signal DS. Alternatively, when the data load signal TP is in the activation state and the polarity control signal POL is in the low level, the over-driver 320 may output the analog voltage AVDD as the data signal DS, and when the data load signal is in the activation state and the polarity control signal POL is in the high level, the over-driver 320 may output the ground voltage GND as the data signal DS.

Figure 4:
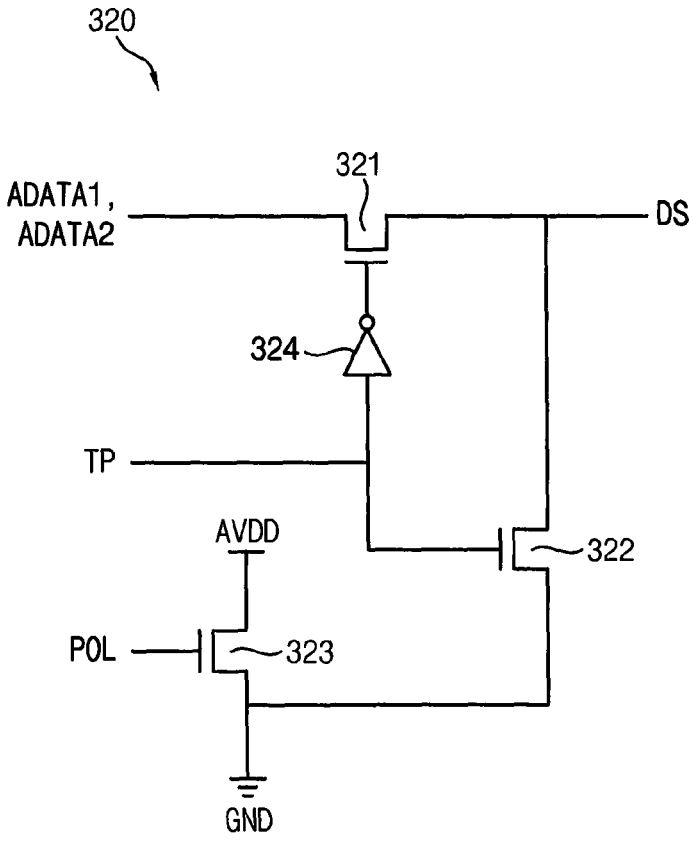
FIG. 4 is a circuit diagram illustrating an exemplary embodiment of an over-driver of FIG. 3.

FIG. 4 is a circuit diagram illustrating an exemplary embodiment of the over-driver 320 of FIG. 3.

Referring to FIGS. 1 to 4, an exemplary embodiment of the over-driver 320 includes a first transistor 321, a second transistor 322, a third transistor 323 and an inverter 324.

In such an embodiment, as shown in FIG. 4, a gate electrode of the first transistor 321 is electrically connected to an output terminal of the inverter 324, a source electrode of the first transistor 321 receives the first analog image data ADATA1 or the second analog image data ADATA2, and a drain electrode of the first transistor 321 outputs the data signal DS. A gate electrode of the second transistor 322 receives the data load signal TP, a source electrode of the second transistor 322 receives the ground voltage GND, and a drain electrode of the second transistor 322 outputs the data signal DS. A gate electrode of the third transistor 323 receives the polarity control signal POL, a source electrode of the third transistor 323 receives the ground voltage GND, and a drain electrode of the third transistor 323 receives the analog voltage AVDD. An input terminal of the inverter 324 receives the data load signal TP, and the output terminal of the inverter 324 is electrically connected to the gate electrode of the first transistor 321.

Figure 5:
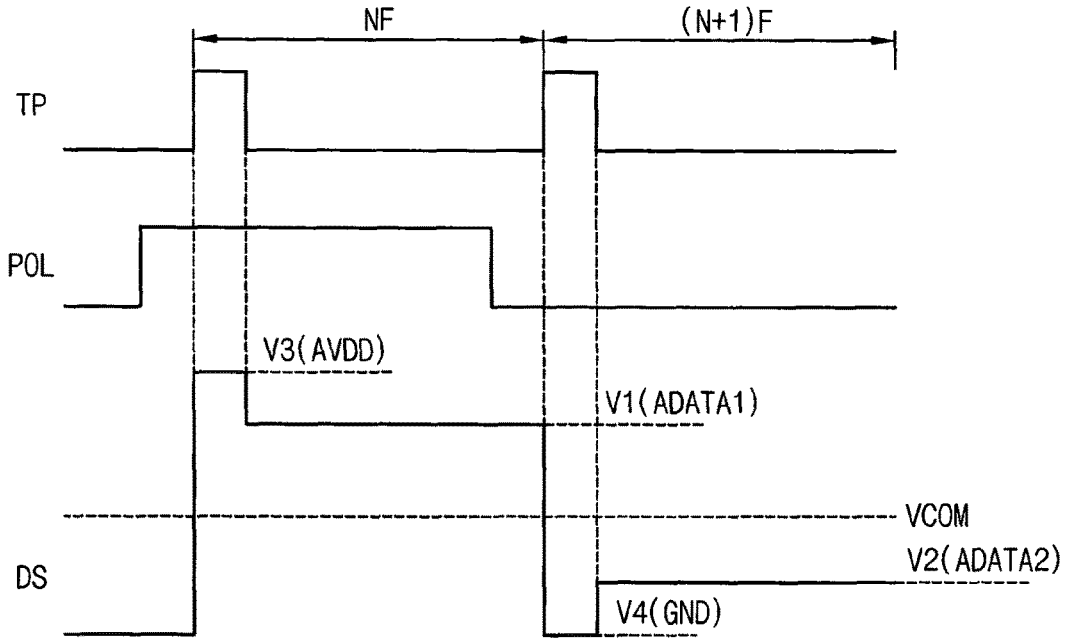
FIG. 5 is waveform diagram illustrating a data load signal, a polarity control signal and a data signal of the over-driver of FIG. 4.
Figure 6A:
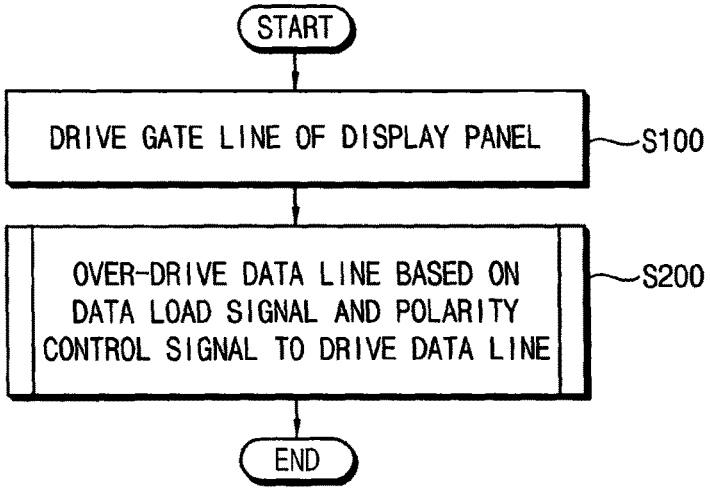
FIGS. 6A to 6D are flowchart illustrating exemplary embodiments of a method of driving a display panel performed by a display panel driving apparatus of FIG. 1.
Figure 6B:
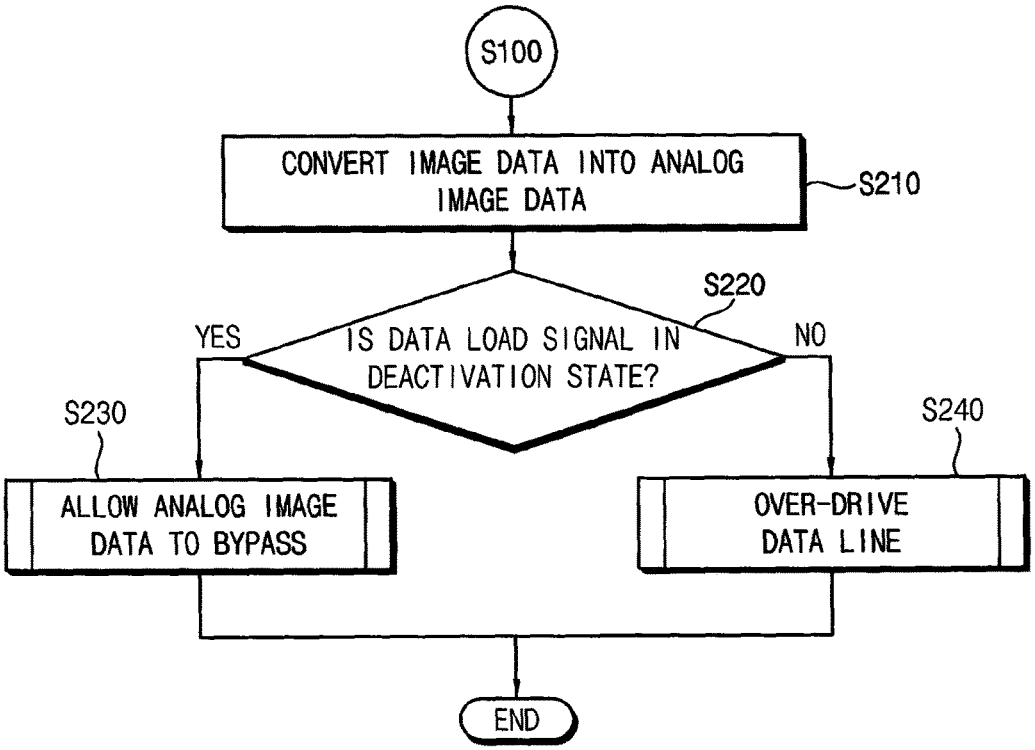
Figure 6C:
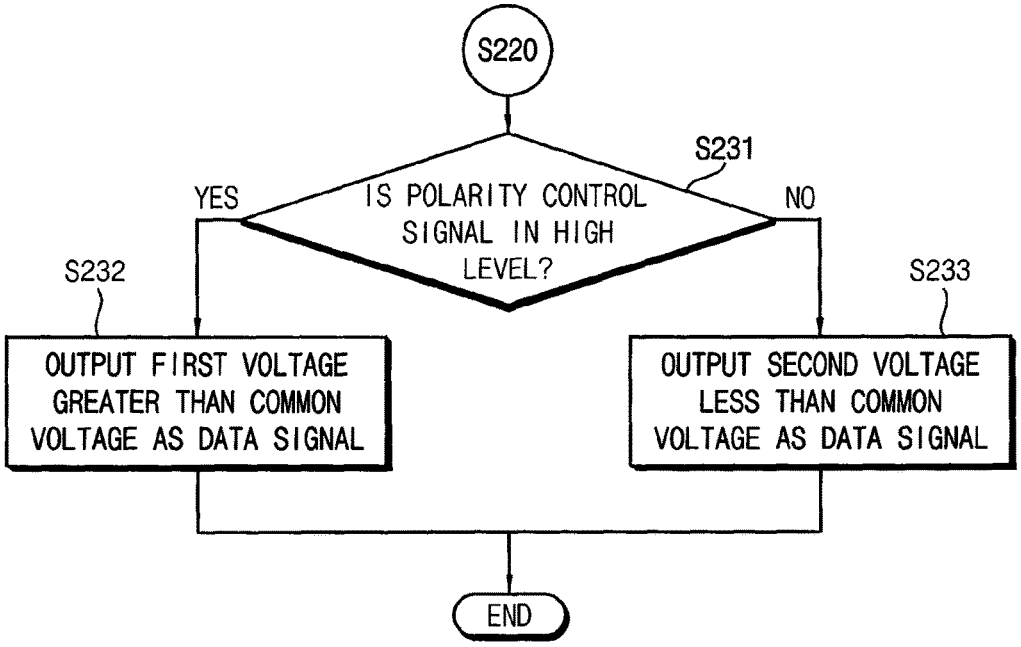
Figure 6D:
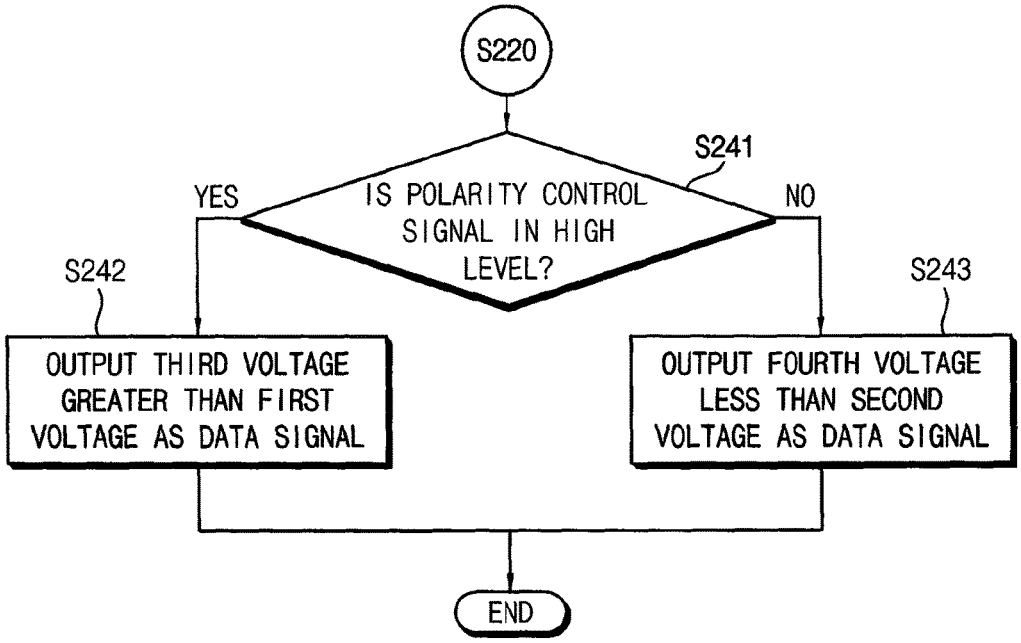

FIG. 5 is waveform diagram illustrating the data load signal TP, the polarity control signal POL and the data signal DS of the over-driver of FIG. 4.

Referring to FIGS. 1 to 5, in an exemplary embodiment, when the data load signal TP is in the deactivation state, the first transistor 321 is turned on, and the first transistor 321 allows the first analog image data ADATA1 or the second analog image data ADATA2 to bypass to thereby output the first analog image data ADATA1 or the second analog image data ADATA2 as the data signal DS.

In such an embodiment, when the data load signal TP is in the deactivation state and the polarity control signal POL is in the high level, the first analog image data ADATA1 is outputted as the data signal DS. In one exemplary embodiment, for example, the first analog image data ADATA1 may be outputted as the data signal DS during an N-th frame NF. Here, N is a natural number.

In such an embodiment, when the data load signal TP is in the deactivation state and the polarity control signal POL is in the low level, the second analog image data ADATA2 is outputted as the data signal DS. In one exemplary embodiment, for example, the second analog image data ADATA2 may be outputted as the data signal DS during an (N+1)-th frame (N+1).

In an exemplary embodiment, when the data load signal is in the activation state, the first transistor 321 is turned off and the second transistor 322 is turned on, and the second transistor 322 outputs the analog voltage AVDD and the ground voltage GND based on the polarity control signal POL.

In such an embodiment, when the data load signal TP is in the activation state and the polarity control signal POL is in the high level, the second transistor 322 is turned on and the third transistor 323 is turned on, and the analog image data AVDD is outputted as the data signal DS. In one exemplary embodiment, for example, the analog image data AVDD may be outputted as the data signal DS during the N-th frame NF. The analog image data AVDD may be outputted during a period corresponding to an activation period (e.g., a high level period) of the data load signal TP in the N-th frame NF.

In such an embodiment, when the data load signal TP is in the activation state and the polarity control signal POL is in the low level, the ground voltage GND is outputted as the data signal DS. In one exemplary embodiment, for example, the ground voltage GND may be outputted as the data signal DS during the (N+1)-th frame (N+1)F. The ground voltage GND may be outputted during a period corresponding to the activation period of the data load signal TP in the (N+1)-th frame (N+1)F.

In an exemplary embodiment, as shown in FIG. 5, the first analog data ADATA1 may have a voltage level of a first voltage V1 greater than the common voltage, the second analog data ADATA2 may have a voltage level of a second voltage V2 less than the common voltage, the analog voltage AVDD may have a voltage level of a third voltage V3 greater than the first voltage V1 of the first analog data ADATA1, and the ground voltage GND may have a voltage level of a fourth voltage V4 less than the second voltage V2 of the second analog data ADATA2. Thus, the data driving part 200 including the over-driving part 300 may over-drive the data line DL.

The data load signal TP may be activated during an initial period of the N-th frame and during an initial period of the (N+1)-th frame (N+1)F. Thus, the data driving part 200 including the over-driving part 300 may increase a response speed of the liquid crystal included in the display panel 110 by over-driving the data line DL.

FIGS. 6A to 6D are flowchart illustrating exemplary embodiments of a method of driving a display panel performed by the display panel driving apparatus 101 of FIG. 1.

Referring to FIGS. 1 to 6D, the gate line GL of the display panel 110 is driven (S100). In an exemplary embodiment, the gate driving part 120 outputs the gate signal GS to the gate line GL of the display panel 110 to drive the gate line GL.

The data line DL is over-driven based on the data load signal TP and the polarity control signal POL to drive the data line DL (S200).

In an exemplary embodiment, the image data DATA is converted into the analog image data ADATA (S210). The analog-digital converting part 210 of the data driving part 200 converts the image data of digital type to the analog image data ADATA of analog type.

The data load signal TP is determined whether the data load signal TP is in the activation state or in the deactivation state (S220).

When the data load signal TP is in the deactivation state, the analog image data ADATA bypasses (S230). In an exemplary embodiment, the polarity control signal POL is determined whether the polarity control signal POL is in the high level or in the low level (S231). When the polarity control signal POL is in the high level, the first voltage V1 greater than the common voltage VCOM is outputted as the data signal DS (S232). The first voltage V1 as the data signal DS may be the first analog image data ADATA1. When the polarity control signal POL is in the low level, the second voltage V2 less than the common voltage VCOM is outputted as the data signal DS (S233). The second voltage V2 as the data signal DS may be the second analog image data ADATA2.

When the data load signal TP is in the activation state, the data line DL is over-driven (S240). In an exemplary embodiment, the polarity control signal POL is determined whether the polarity control signal POL is in the high level or in the low level (S241). When the polarity control signal POL is in the high level, the third voltage V3 greater than the first voltage V1 is outputted as the data signal DS (S242). The third voltage V3 as the data signal DS may be the analog voltage AVDD provided from the voltage generating part 150. When the polarity control signal POL is in the low level, the fourth voltage V4 less than the second voltage V2 is outputted as the data signal DS (S243). The fourth voltage V4 as the data signal DS may be the ground voltage GND provided from the voltage generating part 150.

According to exemplary embodiments, as described above, the data line is over-driven without a memory device that is typically used in a dynamic capacitance compensation ("DCC") method, and thus a manufacturing cost of the display apparatus 100 may be decreased.

In such embodiments, the response speed of the liquid crystal included in the display panel 110 is increased, and thus display quality of the display apparatus 100 may be improved.

Figure 7:
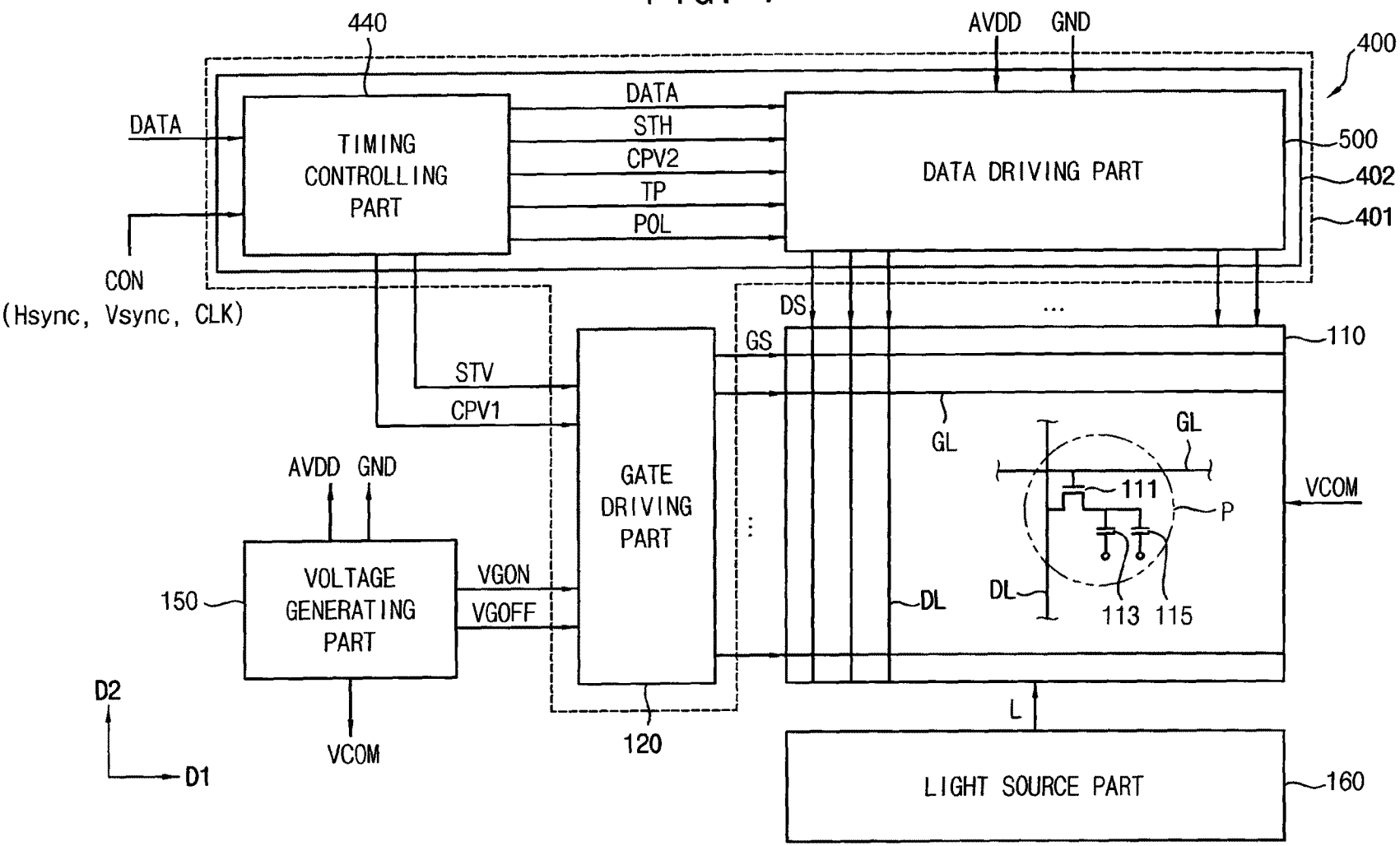
FIG. 7 is a block diagram illustrating an alternative exemplary embodiment of a display apparatus, according to the invention.

FIG. 7 is a block diagram illustrating an alternative exemplary embodiment of a display apparatus, according to the invention.

The display apparatus 400 shown in FIG. 7 is substantially the same as the display apparatus 100 illustrated in FIG. 1 except for the display panel driving apparatus. The same or like elements shown in FIG. 7 have been labeled with the same reference characters as used above to describe the exemplary embodiment of the display apparatus 100 shown in FIG. 1, and any repetitive detailed description thereof will hereinafter be omitted or simplified.

Referring to FIG. 7, an exemplary embodiment of the display apparatus 400 includes the display panel 110, the display panel driving apparatus 401, the voltage generating part 150 and the light source part 160.

The display panel driving apparatus 401 drives the display panel 110. The display panel driving apparatus 401 includes the gate driving part 120, a data driving part 500 and a timing controlling part 440.

In an exemplary embodiment, the timing controlling part 440 and the data driving part 500 may be disposed in a single chip 402. The timing controlling part 440 shown in FIG. 7 is substantially the same as the timing controlling part 140 of FIG. 1. The data driving part 500 shown in FIG. 7 is substantially the same as the data driving part 200 of FIG. 1. In such an embodiment, the data driving part 500 includes the digital-analog converting part 210 and the over-driving part 300, as describe above. Thus, the data driving part 500 including the over-driving part 300 may increase the response speed of the liquid crystal included in the display panel 110 by over-driving the data line DL.

A method of driving a display panel performed by the display panel driving apparatus 401 shown in FIG. 7 is substantially the same as the method of driving the display panel described above with reference to FIGS. 6A to 6D.

According to exemplary embodiments, the data line DL is over-driven without a memory device typically used in a DCC method, and thus a manufacturing cost of the display apparatus 400 may be decreased.

In such embodiments, the response speed of the liquid crystal included in the display panel 110, and thus display quality of the display apparatus 400 may be improved.

In such embodiments, the memory device used in the DCC method is not disposed in the single chip 402 including the timing controlling part 440 and the data driving part 500, and thus a size of the single chip 402 may be decreased.

According to exemplary embodiments of the method of driving the display panel, the display panel driving apparatus performing the method and the display apparatus having the display panel driving apparatus, a data line is over-driven without a memory device typically used in a DCC method, and thus a manufacturing cost of the display apparatus may be decreased.

In such embodiments, a response speed of a liquid crystal included in a display panel of the display apparatus is increased, and thus display quality of the display apparatus may be improved.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display panel driving apparatus comprising:

a gate driver which applies a gate signal to a gate line of a display panel to drive the gate line;

a data driver which applies a data signal to a data line of the display panel, and to over-drive the data line based on a data load signal and a polarity control signal; and a timing controller which controls timings of the gate driver and the data driver, wherein the data driver comprises:

a digital-analog convertor which converts an image data of digital type into an analog image data of analog type; and an over-driver which receives the analog image data and over-drives the data line based on the data load signal and the polarity control signal, and wherein the over-driver comprises:

a first transistor including a source electrode receiving the analog image data, and a drain electrode outputting the data signal;

a second transistor including a gate electrode receiving the data load signal, a gate electrode receiving a ground voltage, and a drain electrode outputting the data signal;

a third transistor including a gate electrode receiving the polarity control signal, a source electrode receiving the ground voltage, and a drain electrode receiving an analog voltage; and an inverter including an input terminal receiving the data load signal, and an output terminal electrically connected to a gate electrode of the first transistor.

2. The display panel driving apparatus of claim 1, wherein the over driver allows the analog image data to bypass when the data load signal is in a deactivation state such that the analog image data is output as the data signal to the data line when the data load signal is in the deactivation state.

3. The display panel driving apparatus of claim 2, wherein the over driver outputs a first voltage, which is greater than a common voltage, as the data signal to the data line when the polarity control signal is in a high level.

4. The display panel driving apparatus of claim 2, wherein the over driver outputs a second voltage, which is less than a common voltage, as the data signal to the data line when the polarity control signal is in a low level.

5. The display panel driving apparatus of claim 1, wherein the over driver determines whether the polarity control signal is in a high level or in a low level when the data load signal is in an activation state.

6. The display panel driving apparatus of claim 5, wherein the over driver outputs a third voltage, which is greater than a first voltage of the analog image data, as the data signal to the data line when the polarity control signal is in the high level, wherein the first voltage of the analog image data is greater than a common voltage, and the over driver outputs a fourth voltage, which is less than a second voltage of the analog image data, as the data signal to the data line when the polarity control signal is in the low level, wherein the second voltage of the analog image data is less than the common voltage.

7. The display panel driving apparatus of claim 6, wherein the a timing controller outputs a gate control signal to the gate driver and outputs a data control signal to the data driver, and wherein the timing controller and the data driver are disposed in a single chip.

8. A display apparatus comprising:

a display panel which displays an image and comprising a gate line and a data line; and a display panel driving apparatus comprising:

a gate driver which applies a gate signal to the gate line to drive the gate line; and a data driver which applies a data signal to a data line of the display panel, and over-drives the data line based on a data load signal and a polarity control signal; and a timing controller which controls timings of the gate driver and the data driver, wherein the data driver comprises:

a digital-analog convertor which converts an image data of digital type into an analog image data of analog type; and an over-driver which receives the analog image data and over-drives the data line based on the data load signal and the polarity control signal, and wherein the over-driver comprises:

a first transistor including a source electrode receiving the analog image data, and a drain electrode outputting the data signal;

a second transistor including a gate electrode receiving the data load signal, a gate electrode receiving a ground voltage, and a drain electrode outputting the data signal;

a third transistor including a gate electrode receiving the polarity control signal, a source electrode receiving the ground voltage, and a drain electrode receiving an analog voltage; and an inverter including an input terminal receiving the data load signal, and an output terminal electrically connected to a gate electrode of the first transistor.

* * * * *